367-94

9/8/81 XR 4,288,867 SR

United States Patent [19]

Guthart

[11] 4,288,867

[45] Sep. 8, 1981

[54] AREA INTRUSION ADJUSTABLE DETECTOR UNIT

[75] Inventor: Leo A. Guthart, Old Westbury, N.Y.

[73] Assignee: Alarm Device Manufacturing Company, Syosset, N.Y.

[21] Appl. No.: 960,727

[22] Filed: Nov. 14, 1978

[51] Int. Cl.[3] ..... G08B 13/16

[52] U.S. Cl. ..... 367/93; 367/94

[58] Field of Search ..... 340/1 R, 558, 559, 560; 310/348, 353; 367/93, 94

[56] References Cited

U.S. PATENT DOCUMENTS

| | | | |
|---|---|---|---|
| 2,733,597 | 2/1956 | Hardy | 367/94 X |
| 3,283,292 | 11/1966 | Kay | 367/93 X |
| 3,286,186 | 11/1966 | White | 367/94 X |
| 3,721,972 | 3/1973 | Hermans | 340/558 X |
| 3,742,434 | 6/1973 | Leyde et al. | 340/1 R |
| 3,803,539 | 4/1974 | McMaster | 367/94 |
| 3,835,254 | 9/1974 | Ohasi et al. | 340/1 R |
| 3,980,998 | 9/1976 | McIntosh | 367/93 |

*Primary Examiner*—David L. Trafton

*Attorney, Agent, or Firm*—Harry Sommers

[57] ABSTRACT

An area intrusion adjustable detector unit having transmitting and receiving transducers which may be accurately aimed and pointed to areas to be monitored without changing the position of or moving the unit. The unit may be in single transmitter-receiver form, or (as for monitoring two separate and distinct areas or rooms) may have two separately mounted and adjustable transmitter-receiver sets, each set adapted to be adjusted for precision aiming independently of the other set for different target areas, without changing the position of the unit. In addition to the transducer aiming features, the unit is adjustable as to regions of air turbulence caused by baseboard radiators, space heaters, fans, etc. resulting in air motion, door, windows and walls vibrating when traffic passes, moving objects such as household pets, and hanging objects that sway, creating misleading doppler shifts of the range that would be caused by a human intruder. Since a greater area of coverage than conventional systems is achieved in the unit, its overall sensitivity, in hostile environments, can be turned down, eliminating coverage of false intrusion signals, while maintaining ample area coverage.

11 Claims, 16 Drawing Figures

AREA INTRUSION ADJUSTABLE DETECTOR UNIT

BACKGROUND OF THE INVENTION

The invention comprises a self-contained ultrasonic intrusion detector-transceiver including novel means adjustable to aim and project and create wave patterns to different areas to be monitored and to receive the echo waves. When the pattern area is penetrated, as by an intruder, some of the standing pattern waves are reflected; a "doppler" shift occurs, proportional to the motion of the intrusion source; the receiver senses the doppler shift and signals an alarm via a relay wired into the protective circuit of the alarm system; the unit works from a house current outlet through a plug-in transformer and rechargeable battery. With the unit cover in place, location of the area pattern coverage is undetectable whereas, in conventional detector units, the position of the unit discloses and betrays the pattern area monitored thereby. In contrast, one who views the unit of the invention with its cover on, as in normal operation, cannot detect the path or orienting and aiming of the transducers and therefore the monitored wave pattern areas for which they are set.

One form of unit has a single set or pair of transmitting and receiving transducers, adjustable to precisely aim them to a target area pattern desired. In the form of the invention having two sets of transmitters and receivers, each set is adjustable to point or aim a different direction; both sets feed into the same electronic circuitry; thus with only one electronic unit of the invention, sets of "doppler" shifts are separately received and processed. One may position one unit on the wall or other support and point one set of transducer transmitters-receivers at one target area and point the other set of transducer transmitter receivers in a different direction, at another target area. Each pair of transducer transmitter-receivers, thus independently aimable, may cover an infinite variety of protective pattern areas, such as separate, angular and odd-shaped rooms and areas, corners, hallways, "L" shaped rooms, "T" shaped halls, etc. (FIGS. 8–12).

Further advantages of the single unit form of this invention with two adjustable sets of transducer transmitters-receivers, compared with two conventional, separate units, each with a single set of fixed transducer transmitters-receivers, are that the cost of two of such conventional units is double the cost of one, and more wall space is required for such two separate units; also, two separate outlets are required.

The motion detector unit of the invention generates waves of predetermined ultrasonic wave length which are transmitted to walls or other target areas, the echos being returned to the receivers and thereby to a piezoelectric or other sensor converting the precalculated ultrasonic wave stress or pressure on the piezoelectric crystal oscillator into an electric charge, tripping a set of dry contacts of a relay, closing a circuit to a control unit and/or an on-premises alarm, triggering alarms such as a bull horn, bell, etc. Once the movement stops the alarm relay locks up another circuit, which will not reset until released, as by a key turned by the unit owner or operator. The alarm systems thus triggered may be audible, visible, and/or of message transmitting form, and may be connected to printout, radio, audio, etc. stations and units, to alert, for example, monitoring stations, such as monitoring police stations and vehicles, closed circuit TV screens, etc.

A typical conventional ultrasonic motion detector has built into it a fixed transmitter and receiver. The unit of the invention utilizes the same electronics and power supply as is usually used to protect one area, to enable adjustment to precisely aim at and cover and monitor separate areas; two transducer units, in one form of the invention, instead of one, share the single electronic circuit, all in one package. The cost of the improved unit is thus little more than that of a unit with a single set of fixed transducers; the improved unit produces twice the area volume of coverage and provides more accurate coverage thereof, at slightly more than or at the same price as that of one conventional fixed transducer unit; each set of the improved unit produces an elliptical sound energy patterns of two times $30\times12\times12$, or a total of $60\times12\times12$.

DESCRIPTION OF THE DRAWINGS

In the drawings, illustrating preferred forms of the invention, and wherein corresponding parts are correspondingly numbered.

DESCRIPTION OF PREFERRED EMBODIMENTS

Figure 1:
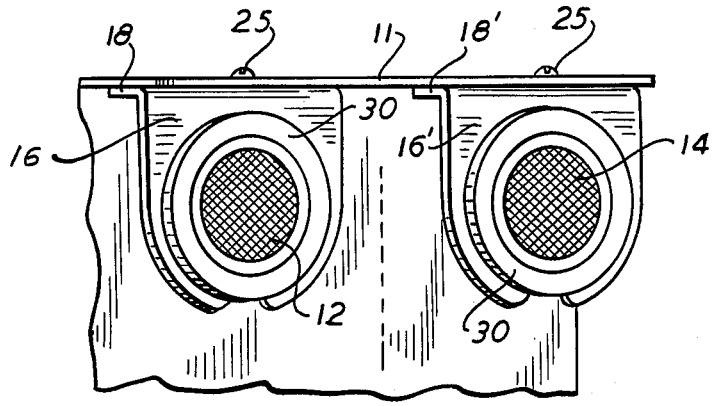
FIG. 1 is a vertical elevational, partly fragmentary, view of a self-contained motion detector unit embodying the invention, for monitoring two different rooms or areas and having independent means for adjustment - aiming of two sets of transmitters-receivers, generating two sets of different pattern area waves and two sets of resultant echo waves.
Figure 2:
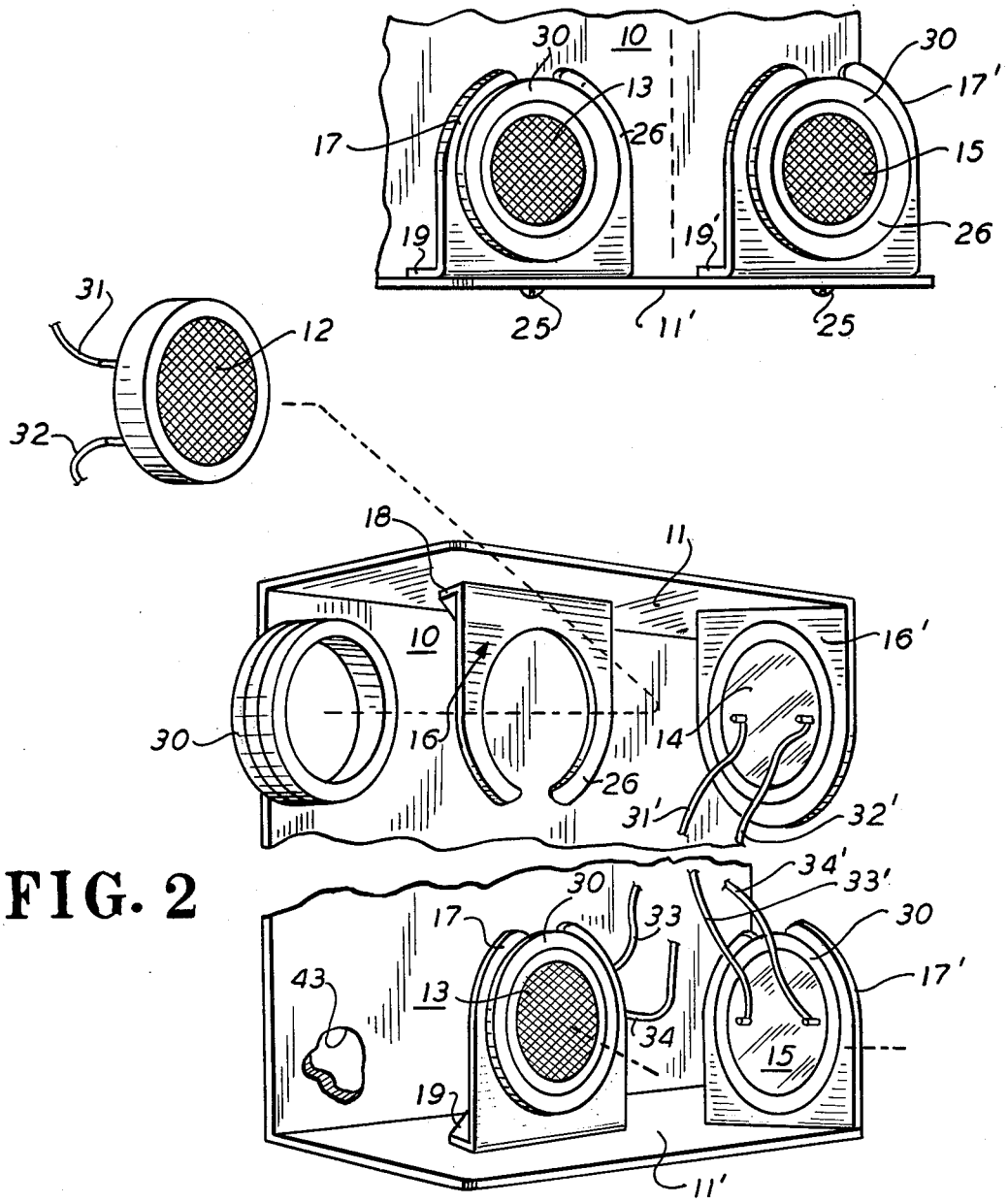
FIG. 2 is a perspective, partly broken view thereof, showing the right-hand set of transmitter-receiver members angularly aimed to monitor an area different from that to which the other set of transmitter-receiver members is aimed, the upper of the left hand set of transmitters-receivers being shown disassembled, in exploded view, to exemplify preferred details thereof.
Figure 3:
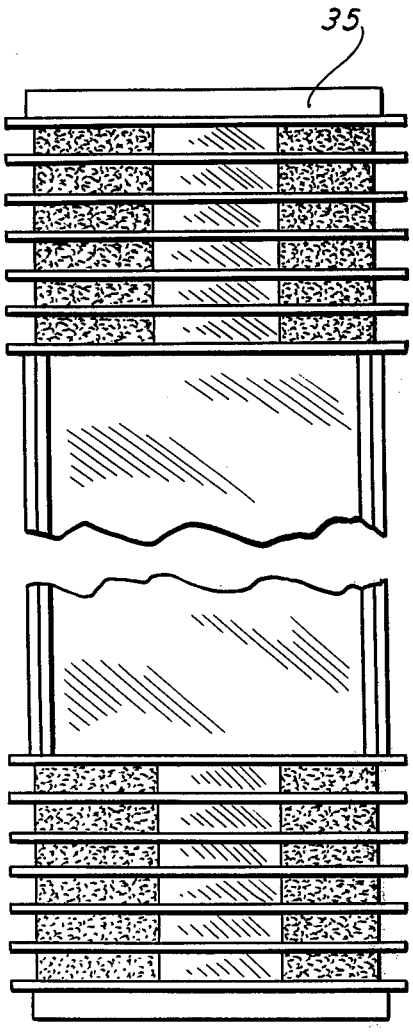
FIG. 3 is a partly fragmentary, top plan view of the unit with a cover member thereon.
Figure 4:
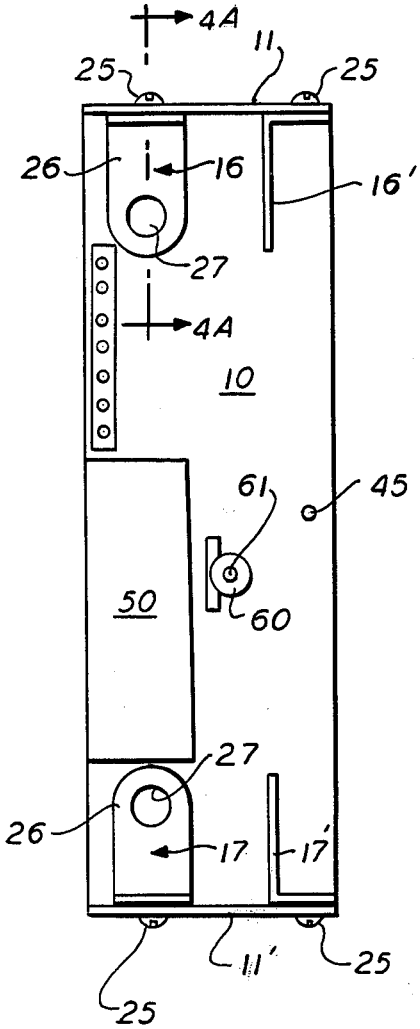
FIG. 4 is a top plan view of the unit, with the (right-hand) set of motion detection transmitters-receivers adjusted (as in FIG. 2) to point or aim at different pattern area modes or directions than the left hand set.
Figure 4A:
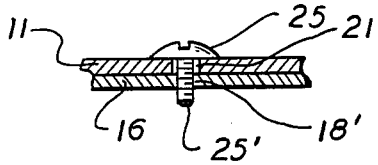
FIG. 4*a* is an enlarged fragmentary, cross-sectional view, taken at line 4*a* —4*a* of FIG. 4.
Figure 6:
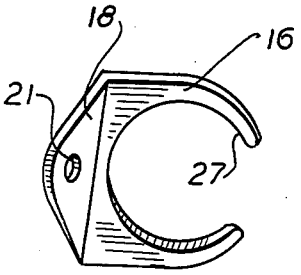
FIG. 6 is a bottom plan, perspective view of a form of bracket member which may be used pursuant to this invention, taken on line 6—6, of FIG. 5.
Figure 6A:
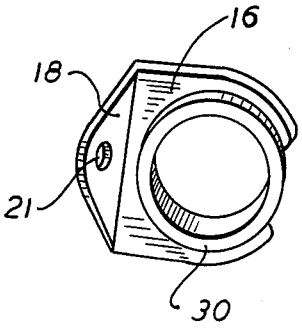
FIG. 6A is a similar view showing the intermediate mounting and cushioning member positioned in the bracket member opening.
Figure 7:
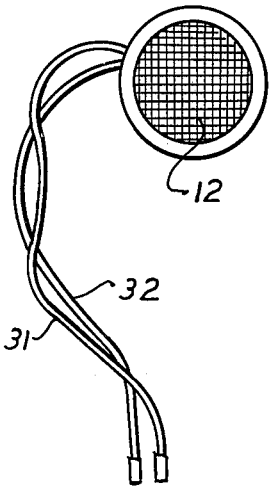
FIG. 7 is a perspective view of member 12 of FIG. 1 and its wires 31, 32 for connection to the electric circuit of the unit (FIGS. 13, 14)

FIGS. 1 and 2 show a form of self-contained motion detector unit 20 embodying the invention, comprising support means such as a frame or chassis bottom plate member 10 on which the components below described are mounted. Support means such as upstanding walls (FIG. 1) 11, 11' are provided on bottom plate member 10, on which, pursuant to the invention, the transmitter and transducer-receiver members 12–13, 14–15, are adjustably mounted by suitable means, such as brackets 16–17, 16'–17' respectively, wherein the transmitters-receivers 12–13, 14–15, are positioned. Said brackets are preferably (FIGS. 6, 6A, 2, 4) L-shaped, with leg portions (FIG. 1) 18–19, 18'–19' which may be connected by connector means freely through apertures 21 (FIGS. 4A, 6 and 6*a*) in the supporting walls 11, 11' of the unit and engaging the internally threaded (25' FIG. 4A) leg portions 18–19, 18'–19' of the brackets.

Figure 5:
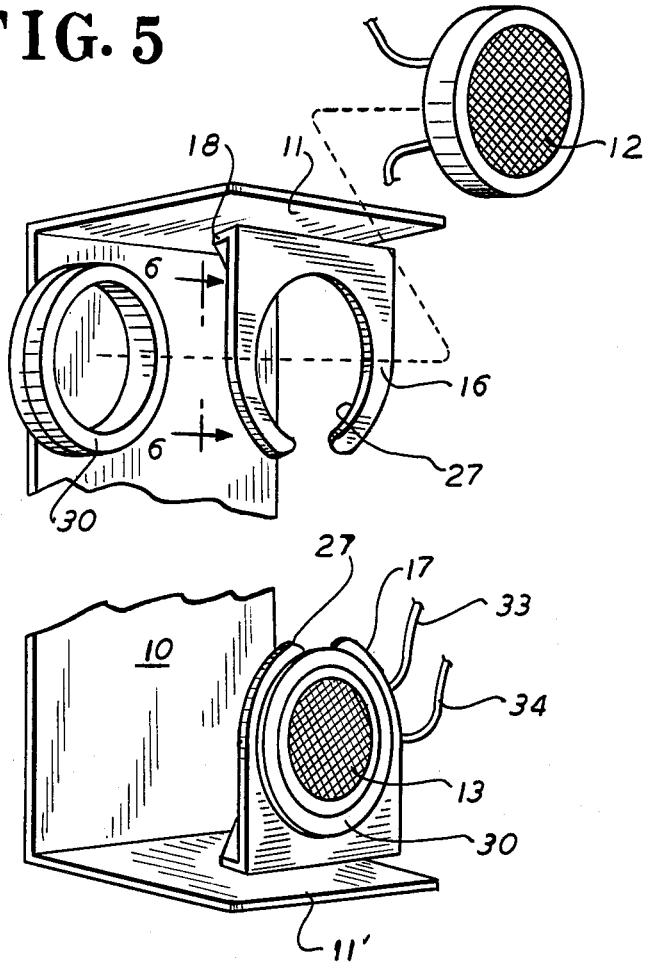
FIG. 5 is a partly fragmentary, perspective view of a detector unit of the invention, in the form having a single pair of transmitter-receiver units adjustably mounted therein for aiming at an area to be monitored thereby, the upper (transmitter) member being shown disassembled to exemplify preferred details thereof.

The brackets may thus be rotated (as in FIGS. 2, 4, 8, 9, 11) to correspondingly rotate the transmitters-receivers and aim them to precisely the angles or positions desired, to target the various areas to be monitored. An infinite number of monitoring area patterns may thus be precisely covered and monitored pursuant to the invention. Each transducer may be released for aiming it by temporarily loosening its securing screw 25 (FIGS. 4A,5) and precision aiming it up to 90° to either side of or "straight ahead"; rotation of brackets 26 aims and points transducer members 12–15 to precisely target the desired monitoring wave patterns.

The top portions 16, 17, 16', 17' of the brackets may be provided with apertures 27 (FIGS. 4, 6, 6A) to receive the transmitters and receivers therein. Intermediary mounting and cushioning, vibration absorbing means such as rings 30 (FIGS. 1, 2, 5, 6*a*) provided, mount the members 12–13, 14–15 therein and thereby in the apertured top portions of the brackets; the apertured top portions 27 of the brackets may be complete (FIG. 4) or discontinuous or split (FIGS. 1, 2, 5, 6) as desired.

Members 12–13, 14–15 may be wired for example (FIG. 2) 31–34, 31'–34', to an appropriate power source (such as 50 below described and exemplified in FIGS. 13, 14) so that the transmitters 12, 14, will transmit ultrasonic sound energy at 40 kHz (40,000 hertz).

Figure 8:
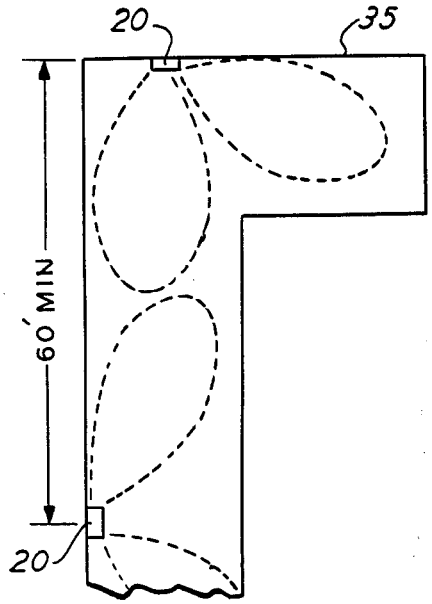
FIG. 8 is a schematic, plan view, showing the wave coverage patterns of two motion detector units of the invention, installed on different walls of a room, each unit having two sets of transmitter-receiver members, the sets being adjusted and aimed for different monitoring area patterns, as shown in dotted lines.
Figure 9:
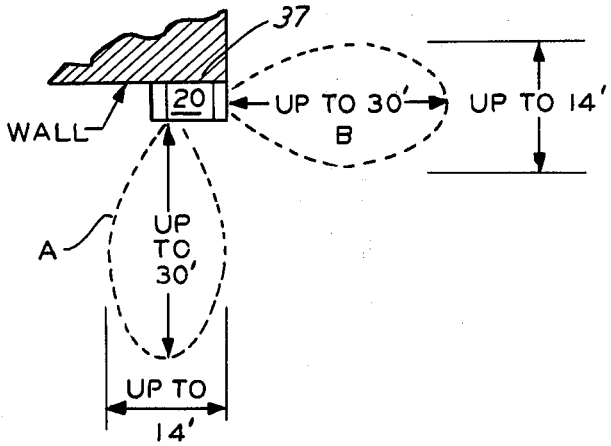
FIG. 9 is a plan view of a motion detector unit of the invention installed at a corner of a member such as a wall 37, and having two sets of transmitter-receiver members adjusted and aimed for monitoring different pattern areas A,B, as shown in dotted lines.

Some of the infinite variety of different area patterns which may be provided by the units of the invention are exemplified in the drawings. In FIG. 8 units 20 are positioned on opposite walls of L-shaped room 35. In FIG. 9 the sets of unit 20 having transmitters-receivers is mounted on a corner or other portion 37 of a wall, providing right angle area pattern A,B, coverage (dotted lines).

Figure 10:
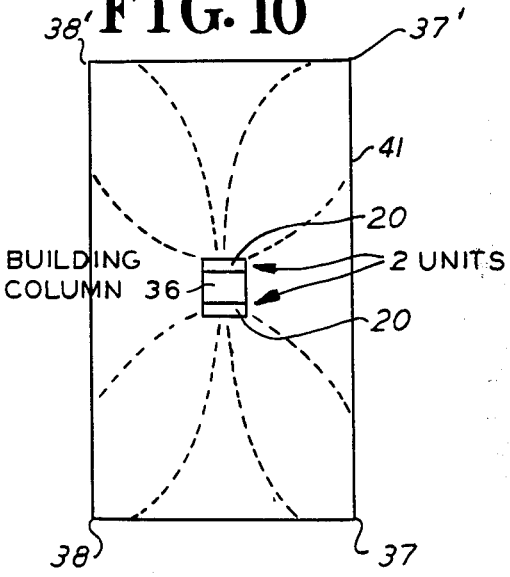
FIG. 10 is a plan view of a pair of motion detector units of the invention, mounted on opposite sides of a building column 36, monitoring four different pattern areas, 37, 37', 38, 38' (shown in dotted lines), at the corners of room 41.
Figure 11:
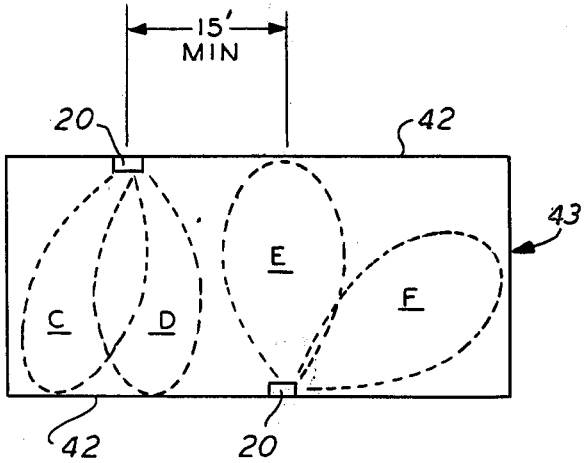
FIG. 11 is a plan view of a pair of detector units embodying the invention, mounted on opposite walls of room 42, each unit having a pair of transmitters-receivers, monitoring pattern areas C–F.
Figure 12:
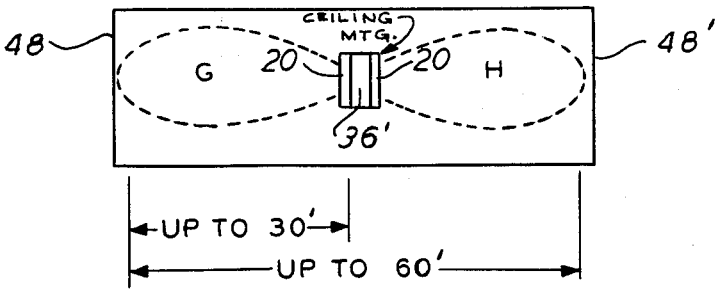
FIG. 12 is a plan view of a ceiling mounted pair of units embodying the invention, each having a single set of transducers, aimed to provide wall area coverage patterns G,H, 180° apart.

In FIG. 10 units 20 are mounted 180° apart on opposite faces of a structural supporting column 36, the sets of transducers in each unit 20 being aimed angularly to provide monitoring patterns directed toward the corners 37, 37',38, 38' of room 41. In FIG. 11 units 20 are mounted on opposite walls of a room, providing area covering patterns C–F. In FIG. 12 units 20 are ceiling mounted, the transducer members in each unit being aimed at opposite walls 48, 48' providing area pattern coverage G,H.

The unit 20 is preferably powered by a battery B 50 (FIGS. 4, 13, 14) such as a nickle-cadmium 1.2 amp battery continually rechargeable through a charger B.C. 51 (FIGS. 13, 14) connected, by a suitable transformer plug 54, to a conventional wall outlet W52. In case of power failure of the wall outlet W 52 the form, such as nickel cadmium, of unit battery B 50, is capable of providing 12 hours of continuous use fully charged. At the end of the power or stand-by period, the unit would fail in the safe condition, sounding an alarm. The unit 20 has a wall test light 45 (FIGS. 4, 14) so that, when the system is being tested when installed, every time sufficient motion occurs to cause the instrument to go into an alarm triggering mode, the LED will come on. It is left in the unit but only used during testing; the owner may want to test it on a periodic basis, but every time the unit triggers, the LED will come on.

Figure 13:
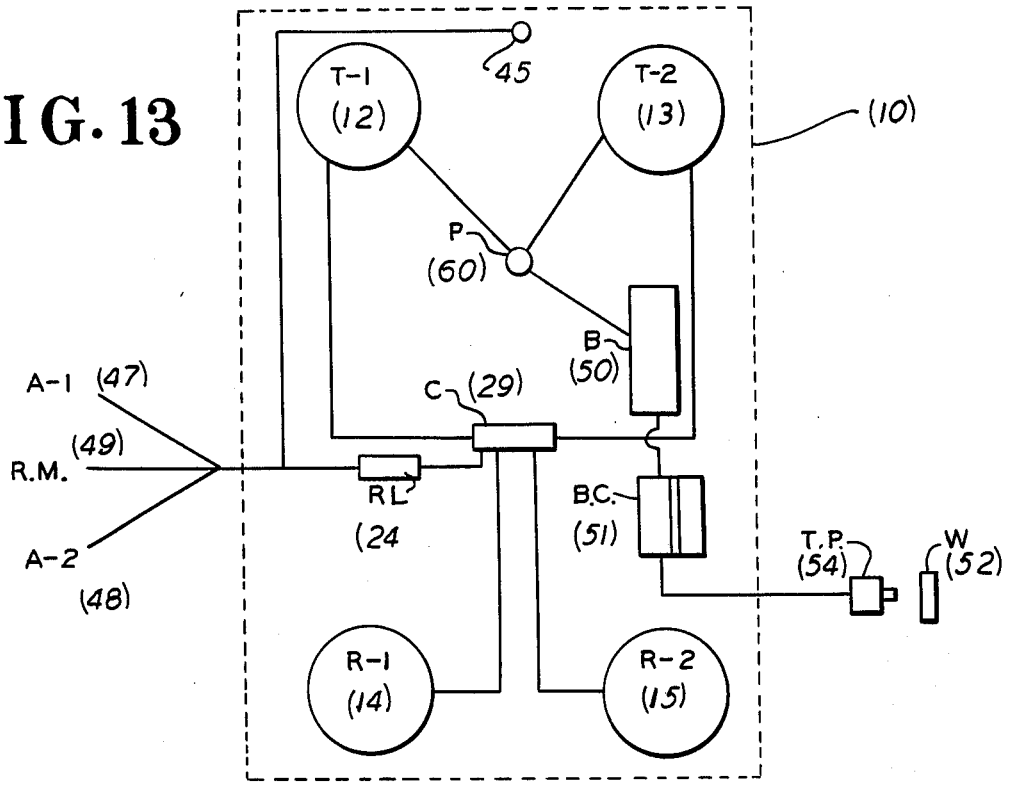
FIGS. 13 and 14 are schematic block diagrams of units of the invention in double and single transducer form sets.
Figure 14:
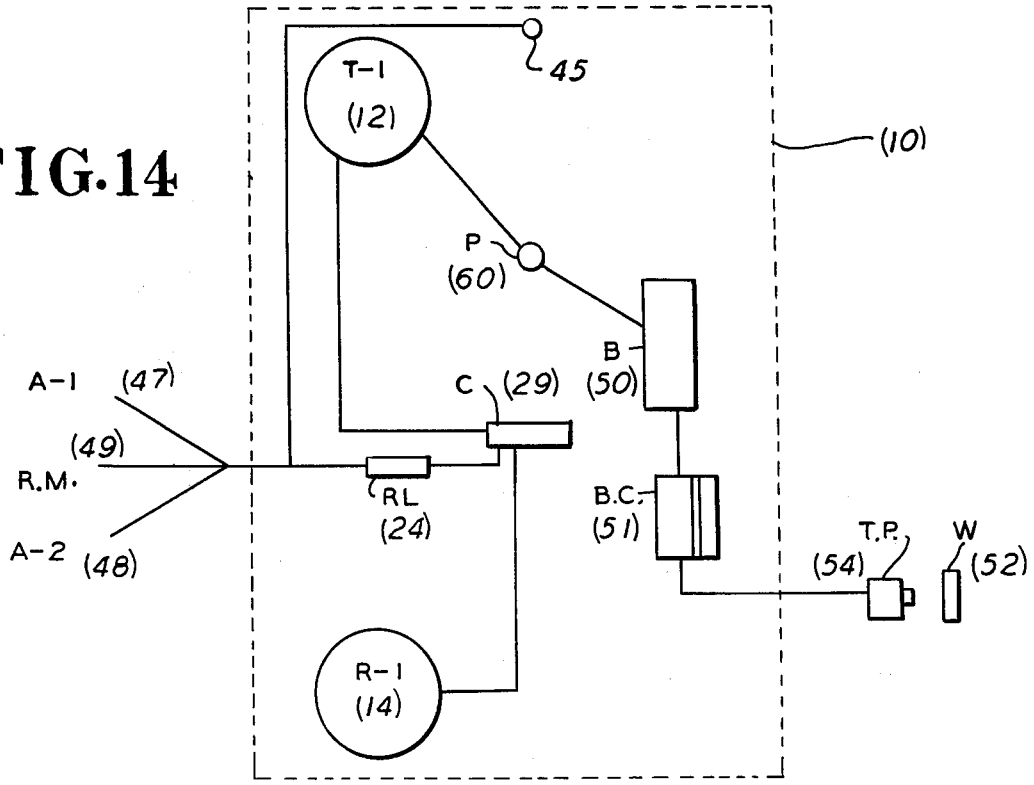

From the disclosures herein it will be seen that the invention thus comprises a self-contained electronic package or unit which receives doppler shifts and processes them into alarms. The unit may be positioned on a wall and one set of transducers pointed or aimed in one direction and another set of transducers in a different direction, hence covering area ranges more accurately and of far greater volume than conventional units, with their fixed position transducers cover. The term "wall" as used in this specification and claims is exemplified in FIG. 9 as a corner wall on which the detector unit is mounted at a right angle; in FIGS. 8 and 11 detector units are shown mounted on opposite walls 40, 41 of a room; in FIGS. 12 and 10 the detector units are mounted on a building column and a ceiling of a room; these examples in FIGS. 9–11 are illustrative of an infinite variety of mounting arrangements wherein the detector unit of this invention may be mounted. In FIGS. 13 and 14 block diagrams show the detector unit of this invention in double and single unit forms. The term "wall" thus shall be deemed to include any standing fixed position interior wall with respect to which the detector unit of this invention is mounted in spaced relation and whether the wall is a standing wall, side wall, top or ceiling wall or floor or bottom wall. The unit of this invention is designed for use in interior areas such as homes, offices, plants and the like—not for exterior use, as in submarines wherein detection is made subjectively by the operator through earphones and through turbulent waters, garage doors and other exterior locations and uses. The term "unit" as used in the specification and claims connotes the single form (FIG. 5) as well as the double form thereof as shown in remaining figures.

The pattern of ultrasonic waves emitted by each pair (12–13, 14–15) of transducers is oblong and at maximum sensitivity has a nominal range of up to 30 feet and a width (FIG. 9) of approximately 14 feet. The signals are additive, and might thus be expected to be subject to trouble from false alarms. But the unit importantly covers the greater volumetric area; in a hostile environment it puts out twice as much volumetric signal; having two transmitters, it can function with half the gain if the volume is turned down, for example, by potentiometer 60 (FIGS. 4, 13, 14) or other control-adjustment. In a non-hostile environment, the unit volume does not have to be turned down and all the gain may be realized—the unit, covering twice the volume of a single unit utilizes the circuitry and housing features of only a single unit, with slightly less increase in initial and operating cost, thus gives alternately better performance in hostile environments or more performance in non-hostile environments. It is a self-contained ultrasonic intrusion detector (transceiver) unique in combining, in a single housing, a dual set of transmitters-receivers and adjustable for example, as by range adjustment potentiometer 60 which (FIGS. 13, 14) adjusting both sets of transducers cut into the circuit from battery 50 to the transmitters-receivers. The potentiometer P(60) FIG. 13, provided with a slot 61 (FIG. 4) for rotation-clockwise for plus, or counterclockwise for minus, to increase or decrease the power transmitted. Thus the range of ultrasonic wave transmission may be set short of areas of anticipated false interference intrusion; the unit may be set by the range adjustment transducer potentiometer 60 (FIG. 4) to be alarm activated by an intruder's presence but not by random noises or random waves that would generate false alarms if the wave pattern were set to extend beyond a given range.

The audio visual etc. alarm systems such as (FIG. 13) A (47), remote RM (49), and other systems such as A 2 (48) may be triggered to signal intrusion into a monitored area by the control circuit crystal (29) sensing the Doppler effect monitored by transmitters T-1 (12) vis-a-vis receiver R-1 (14), T 2 (13) vis-a-vis R 2 (15), actuating the relay R L (24) to the alarm systems.

While the invention has been set forth above in terms of a specific embodiment thereof, it is to be understood that variations therein may be made by those skilled in the art, which variations may nevertheless be within the scope and spirit of the invention, In view thereof, the invention is to be broadly construed within the scope and spirit of the claims appended hereto.

I claim:

1. A detector unit for detection of intrusion in an interior area between said detector unit and a wall spaced from said unit, comprising:

(a) a chassis frame, (b) a transducer-transmitter, (c) a transducer-receiver, (d) bracket means mounting said transducer-transmitter and said transducer-receiver on said chassis frame, (e) swiveling means engageable with said bracket means and with said chassis frame, rotatably so mounting said bracket means on said frame, (f) means energizing said transducer-transmitter to beam ultrasonic waves into said area to be so monitored for intrusion, with the echoes of said waves so beamed returning to said transducer-receiver, (g) said means so securing the transducer-transmitter and transducer-receiver, to thereby fix the paths of transmission and return echo waves, and (h) means comparing the energy value of the echo waves so returned with that of the waves so beamed, for generating an alarm circuit responsive to the difference in value between the waves so beamed and the echo waves so returned.

2. In a detector unit for detection of intrusion in an interior area between said detector unit and a wall spaced therefrom as set forth in claim 1, said means so rotatably mounting said bracket means on the chassis frame comprising means passing through apertures provided therein, and adjustably so connecting the bracket means to the frame.

3. In a detector unit for detection of intrusion in an interior area between said detector unit and a wall spaced therefrom, as set forth in claim 1, said bracket means including a portion extending angularly therefrom, and means mounting said transducer-transmitter and transducer-receiver in said so angularly extending portions of the bracket means.

4. In a detector unit for detection of intrusion in an interior area between said detector unit and a wall spaced therefrom, as set forth in claim 1, said bracket means including a portion angularly therefrom and recessed, said transducer-transmitter and said transducer-receiver being positioned in said recessed portions of said bracket means.

5. In a detector unit for detection of intrusion in an interior area between said detector unit and a wall spaced therefrom, as set forth in claim 1, said means so rotatably mounting the bracket means on the frame rotatably in reverse directions.

6. In a detector unit for detection of intrusion in an interior area between said detector unit and a wall spaced therefrom, as set forth in claim 1, said bracket means including portions extending therefrom, said extending portions being apertured, cushioning means positioned in said apertured portions of the brackets, said transducer-transmitter and said transducer-receiver being positioned in said cushioning means.

7. In a detector unit for detection of intrusion in an interior area between said detector unit and a wall spaced therefrom, as set forth in claim 1, a potentiometer for connecting a power source to said transducer-transmitter, and means for adjusting the potentiometer for increase or decrease of the power transmitted therethrough and thereby adjusting the effective monitoring area of said transducer-transmitter and transducer-receiver.

8. In a detector unit for detection of intrusion in an interior area between said detector unit and a wall spaced therefrom, as set forth in claim 1, a second set of transducer-transmitter and transducer-receiver members, means positioning said second set of members in said unit spaced from the first set, means energizing the transducers-transmitters of the first and second sets, to beam electronic waves into respective different areas to be monitored, echoes of said waves so beamed returning to said transducers-receivers, means connected to said receivers in each set, comparing the echo waves so returned thereto with the waves so transmitted, and means actuated by said means so connected and generating an alarm responsive to a difference in value of the echo waves so returned from the waves so generated.

9. In a detector unit for detection of intrusion in an interior area between said detector unit and a wall spaced therefrom, as set forth in claim 1, covering means in said unit covering the transducers therein from external observation of the aiming positions thereof and thereby concealing the paths of projection and return of the waves, and thus the areas monitored thereby.

10. In a detector unit for detection of intrusion in an interior area between said detector unit and a wall spaced therefrom, as set forth in claim 1, a second set of transducer-transmitter and transducer-receiver members, means positioning said second set of members rotatably adjustably in said unit in spaced angular relation to the first-mentioned set, for aiming the second set of members to a different area to be monitored than that to be monitored by the first set, means energizing each transducer-transmitter to beam electronic waves into each area to be so monitored, echoes of said waves so beamed returning to said receivers, and said means positioning said transmitters and receivers in said unit including means for precisely moving them and locking them in desired positions of registration with the areas to be so monitored thereby, and so fixing the paths of transmission and echo reception waves for each of said areas.

11. A detector unit for detection of intrusion in interior areas between said detector unit and walls angularly spaced from each other and from said unit, comprising, (a) a chassis frame for said unit, (b) first and second sets of transducers-transmitters and transducers-receivers, (c) said sets being positioned in spaced apart relation in said chassis, each set including:

(d) bracket means mounting said sets of transducers-transmitters and transducers-receivers in angularly spaced apart position in said chassis frame, (e) means engageable with said bracket means and frame, swivelly reversibly so mounting said bracket means on said frame, (f) said means so securing the sets of transducers-transmitters and transducers-receivers in calculated desired positions of registration relative to the separate areas to be so monitored, thereby fixing the paths of transmission and return echo waves for each set, and (g) means energizing said transducers-transmitters to beam ultrasonic waves into said areas to be so monitored.

* * * * *